US010434769B2

(12) United States Patent
Veis et al.

(10) Patent No.: US 10,434,769 B2
(45) Date of Patent: Oct. 8, 2019

(54) METHOD AND PRINTING SYSTEM FOR DEPOSITING PRINTING FLUID ON A SHEET OF CORRUGATED MEDIA

(71) Applicant: HP SCITEX LTD., Netanya (IL)

(72) Inventors: Alex Veis, Kadima (IL); Yuval Dim, Moshav Haniel (IL); Semion Birger, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/994,395

(22) Filed: May 31, 2018

(65) Prior Publication Data

US 2019/0030887 A1 Jan. 31, 2019

(30) Foreign Application Priority Data

Jul. 31, 2017 (EP) ..... 17184098

(51) Int. Cl.

| | |
|---|---|
| ***B41J 11/00*** | (2006.01) |
| ***B41J 2/045*** | (2006.01) |
| ***B41J 3/407*** | (2006.01) |
| ***B41J 13/00*** | (2006.01) |
| ***B41J 25/308*** | (2006.01) |

(52) U.S. Cl.

CPC ..... *B41J 2/04556* (2013.01); *B41J 2/04586* (2013.01); *B41J 3/4073* (2013.01); *B41J 11/008* (2013.01); *B41J 11/0095* (2013.01); *B41J 13/0063* (2013.01); *B41J 25/308* (2013.01)

(58) Field of Classification Search

CPC .. B41J 2/04556; B41J 2/04586; B41J 25/308; B41J 3/4073; B41J 11/0095; B41J 11/008; B41J 13/0063

See application file for complete search history.

(56) References Cited

U.S. PATENT DOCUMENTS

| | | | | |
|---|---|---|---|---|
| 4,966,074 | A | 10/1990 | Aldrich | |
| 5,581,353 | A | 12/1996 | Taylor | |
| 6,165,562 | A | 12/2000 | Mizuno | |
| 8,025,354 | B2 * | 9/2011 | Baker | B41J 29/393 347/14 |
| 8,186,787 | B2 * | 5/2012 | Holbrook | B41J 25/308 347/16 |
| 2007/0247505 | A1 * | 10/2007 | Isowa | B41J 3/407 347/101 |
| 2015/0298473 | A1 | 10/2015 | Hara et al. | |
| 2016/0103632 | A1 * | 4/2016 | Kawaguchi | B41J 11/0095 347/19 |

FOREIGN PATENT DOCUMENTS

JP 2008230069 A 10/2008

OTHER PUBLICATIONS

Focus:Direct Offset Printing on Corrugated Board, 2002, <http://www2.kba.com/fileadmin/user_upload/KBA_Prozess/1_en.pdf >.

* cited by examiner

*Primary Examiner* — Sharon A. Polk

(74) *Attorney, Agent, or Firm* — Dierker & Kavanaugh PC

(57) ABSTRACT

A method of depositing printing fluid on a sheet of corrugated media comprises determining a deformation of a sheet of corrugated media, adjusting control parameters for a plurality of nozzles based on the determined deformation, and depositing printing fluid from the plurality of nozzles onto the sheet of corrugated media according to the adjusted control parameters.

9 Claims, 5 Drawing Sheets

METHOD AND PRINTING SYSTEM FOR DEPOSITING PRINTING FLUID ON A SHEET OF CORRUGATED MEDIA

BACKGROUND

Printing devices are arranged to print ink on to different media, which can include corrugated media. An example printing device comprises one or more print heads, each print head comprising one or more nozzles. These nozzles are arranged to deposit ink droplets onto media. The printed media may then coated with printing fluid such as varnish or gloss by directly applying a surface, such as a roller, coated in the printing fluid to the printed media.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
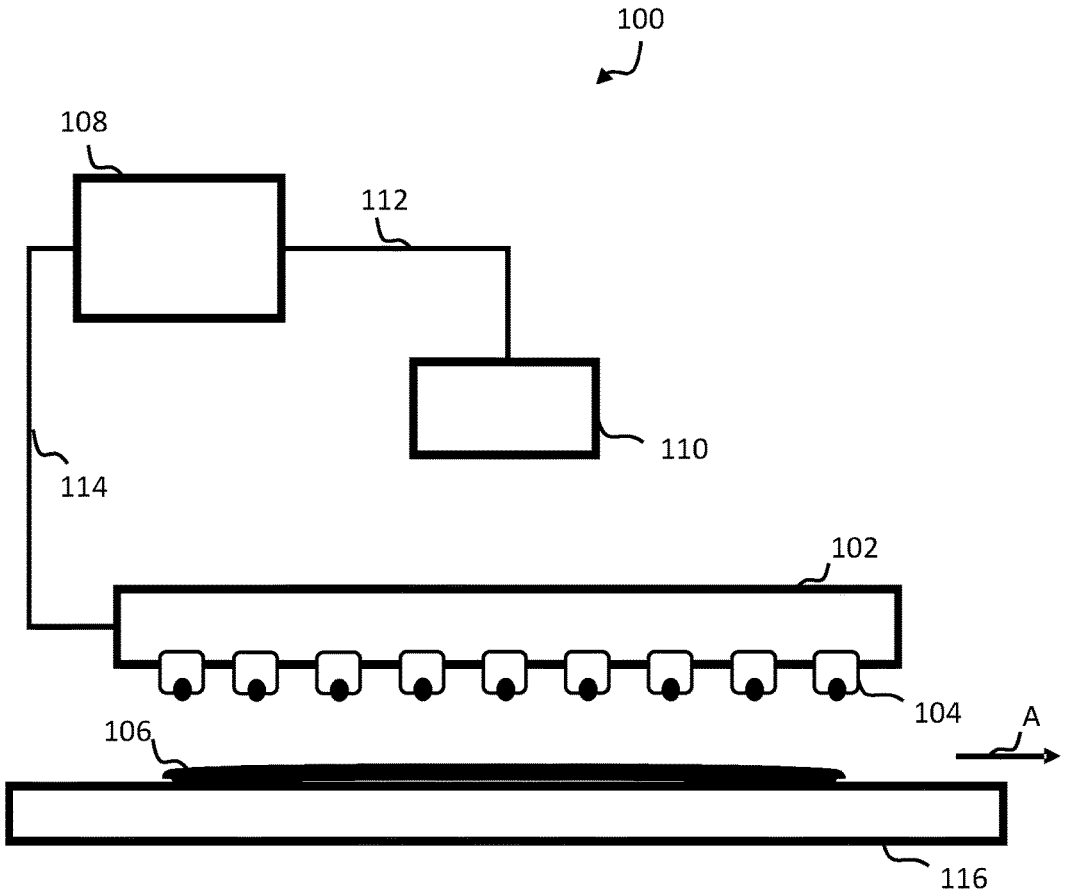
FIG. 1 is a schematic diagram showing a printing system in accordance with an example.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

As described herein, an example printing system comprises an array of nozzles and a print controller. The array of nozzles are arranged to deposit printing fluid, such as ink, gloss or varnish, on to a sheet of corrugated media, such as cardboard. In one example, the array of nozzles may be used instead of applying gloss or varnish by contacting printed media with a surface coated in the gloss or varnish. In another example, the array of nozzles may deposit ink onto corrugated media to form an image.

An example corrugated media comprises corrugations located between two outer layers. If the corrugated media is substantially flat, the media will be covered evenly by the printing fluid. However, in some circumstances corrugated media may be deformed, for example the media may be warped, bent, creased or dented. This may be a result of the manufacturing process itself, as a result of improper storage or handling of the media, or as a result of moisture in the ink printed onto the media, for example. If the printing fluid were to be applied normally to deformed media, the printing fluid may be applied non-uniformly, which can cause undesirable visible effects, such as lines and a change in gloss or colour hue. Accordingly, an example printing system described herein can adapt how the printing fluid is applied depending upon the level of deformation. An example method performed by the printing system comprises determining the deformation of the corrugated media. For example, the printing system may be arranged to determine, measure, record, or quantify the deformation of the corrugated media before depositing the printing fluid on to the media. Once determined, control parameters for the plurality of nozzles may be adjusted, based on the determined deformation, before depositing the printing fluid from the plurality of nozzles onto the sheet of corrugated media. In this manner, the printing fluid may be applied in a manner suitable for the deformation, thus reducing or even eliminating the presence of these unwanted visual effects. The print controller of the printing system may therefore be configured to receive sensor data of the sheet of corrugated media. The print controller determines the deformation of the sheet of corrugated media based on the sensor data and adjusts control parameters for the array of nozzles based on the deformation. The print controller may control the array of nozzles to deposit printing fluid onto the sheet of corrugated media based on the adjusted control parameters. Accordingly, the example printing system can apply printing fluid on corrugated media without affecting the structural integrity of the corrugated media and without introducing unwanted visible effects.

FIG. 1 is a schematic diagram showing a printing system 100 in accordance with an example. The printing system 100 comprises an array of nozzles 102, where the array of nozzles 102 comprises one or more nozzles 104. The array of nozzles 102 are arranged to deposit printing fluid onto a sheet of corrugated media 106. The printing system 100 also comprises a print controller 108, which can be used to control elements within the printing system 100. An example print controller 108 comprises one or more processors and memory, such as a non-transitory computer-readable storage medium. The printing system 100 in this example also comprises a sensor device 110, however it will be appreciated that the sensor device 110 may be separate from the printing system 110, but communicatively coupled to the printing system 110. The sensor device 110 may be connected directly or indirectly to the print controller 108 via a communication path 112 to allow the transmission of data between the print controller 108 and sensor device 110. The sensor device 110 may be used to sense the deformation of the corrugated media 106 and therefore gather or record sensor data.

The print controller 108 may also be connected, directly or indirectly to the array of nozzles 102 via a communication path 114 to allow the transmission of data between the print controller 108 and the array of nozzles 102. The communication path 114 allows the print controller 108 to control the array of nozzles 102 as a whole, and/or control each nozzle 104 individually. The print controller 108 may send control signals/instructions along the communication path 114, which cause the array of nozzles 102 and/or each nozzle 104 to respond according to the instruction. For example, the instructions may cause one or more nozzles 104 to adjust their angle of tilt, their vertical distance from the sheet of corrugated media 106, their spray angle, their spray flow intensity, and/or their motion. These instructions sent by the print controller 108 may be different depending upon the deformation of the corrugated media 106.

Figure 2:
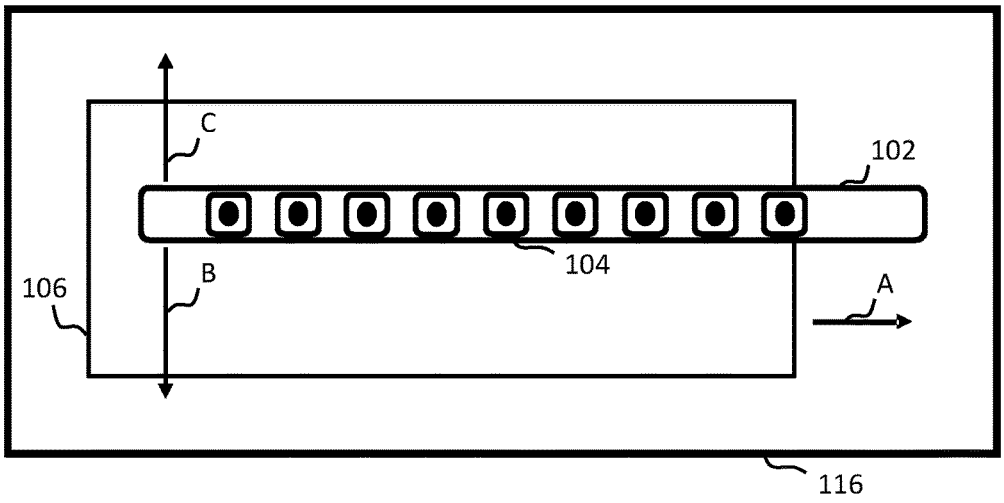
FIG. 2 is a schematic diagram showing a top down view of a portion of the printing system in accordance with an example.

In some examples, the corrugated media 106 may be stationary when the printing fluid is applied by the nozzles 104. However, in the examples of FIGS. 1-4, the corrugated media 106 is transported through the printer system 100 by the conveyor belt 116 in the direction indicated by the arrow A. In some examples, the array of nozzles 102 may also move in a direction parallel or antiparallel to the arrow A. In other examples, the array of nozzles 102 may additionally or alternatively move in a direction perpendicular to the arrow A. For example, they may move towards and away from the corrugated media 106 and/or into and out of the page in FIG. 1, for example in the directions indicated by arrows B and C in FIG. 2. The movement of the array of nozzles 102 allows complete coverage of the corrugated media 106 by the printing fluid. As mentioned above, this motion may be controlled by the print controller 108.

Figure 3:
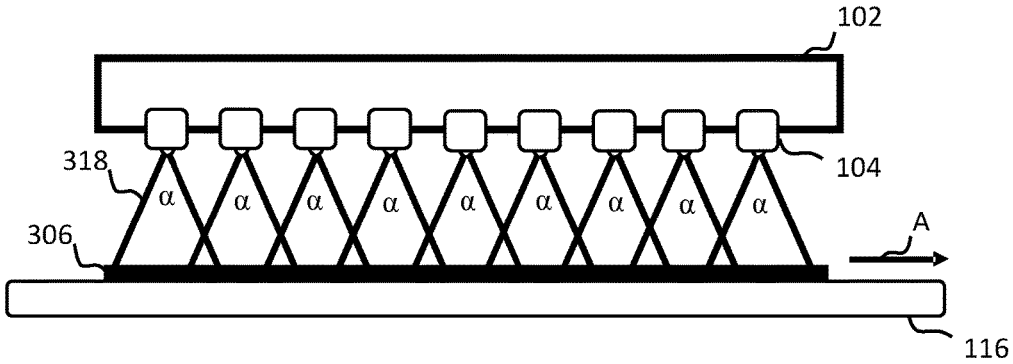
FIG. 3 is a schematic diagram showing a portion of the printing system and a type of corrugated media in accordance with an example.

FIG. 3 is a schematic diagram showing part of the printing system 100. In this example, the corrugated media 306 is flat, or substantially flat. As the corrugated media 306 is transported beneath the array of nozzles 102 in the direction of the arrow A, printing fluid 318 is deposited on the surface of the corrugated media 306. This coating of printing fluid 318 may be applied by one or more of the nozzles 104 as desired. The printing fluid 318 may be applied by spraying a constant or intermittent spray from the nozzles 104. A fixed volume of fluid may be applied per unit time to ensure a constant and uniform application of printing fluid 318 is applied to the corrugated media 306. In this example, the printing fluid 318 is sprayed from each of the nozzles 104 at a spray angle $\alpha$ and the volume of printing fluid in transit towards the surface of the sheet of corrugated media 306 may be approximately conical in shape. In this example, certain regions on the surface of the sheet of corrugated media 306 will simultaneously receive printing fluid from two adjacent nozzles 104, so there may be areas of overlap. However, it can be seen that this area of overlap is consistent for each region of overlap and the motion of the corrugated media 306 under the array of nozzles 102 ensure that each point on the surface of the corrugated media 306 will receive approximately the same volume of printing fluid. This results in a uniform layer of printing fluid being applied to the flat corrugated media 306 so that no, or minimal, unwanted visual effects are present.

Figure 4A:
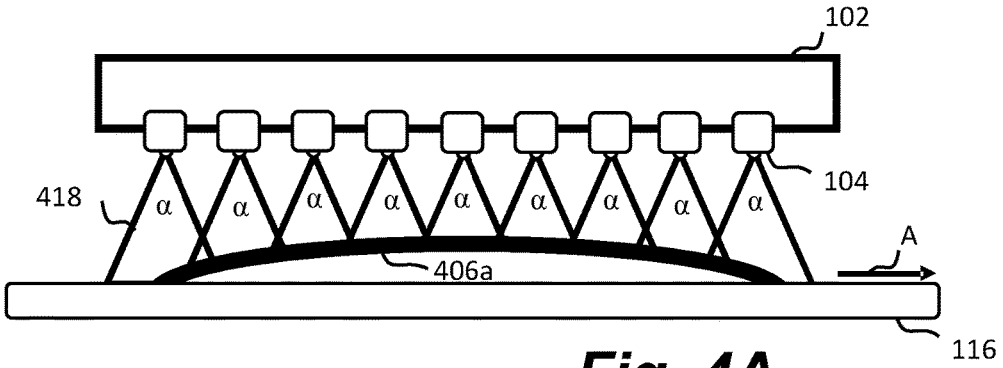
FIG. 4A is a schematic diagram showing a portion of the printing system and a type of corrugated media in accordance with an example.
Figure 4B:
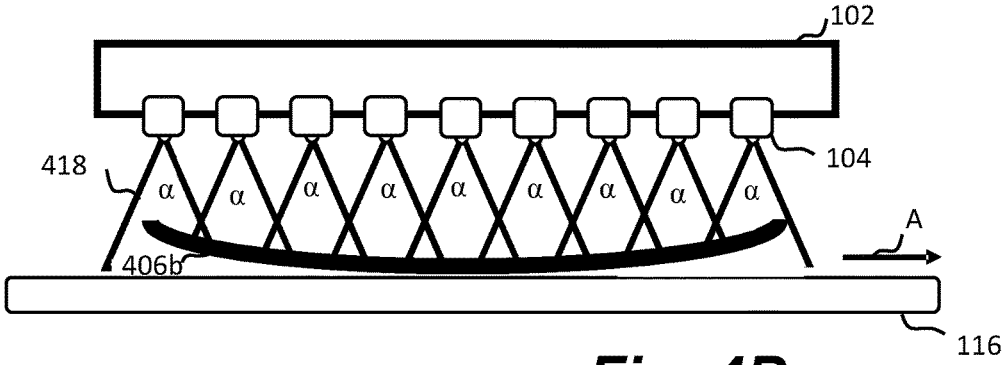
FIG. 4B is a schematic diagram showing a portion of the printing system and a type of corrugated media in accordance with an example.

As mentioned above, corrugated media may not always be flat because it is particularly prone to being deformed. FIGS. 4A and 4B show two examples of deformed corrugated media 406*a*, 406*b* in the printing system 100. FIG. 4A depicts corrugated media 406*a* that is convex in nature. The central region of the sheet 406*a* is displaced from the conveyor belt 116 surface to a greater extent than the end regions. This displacement may be called a height displacement, and is displaced with respect to a reference height, such as the top surface of the conveyor belt 116. In some examples, the height displacement may be defined as being a displacement in a direction perpendicular to a direction of media transport.

In the example of FIG. 4A, the control parameters of the plurality of nozzles 104 are the same as in FIG. 3 for the flat corrugated media 306. As a result, locations on the surface of the corrugated media 406*a* that have a greater height displacement may receive a higher volume of printing fluid 418 than locations with a lower height displacement. This is by virtue of being closer to the nozzles 104 as they deposit printing fluid 418. Furthermore, unlike in FIG. 3, the areas of overlap from adjacent nozzles 104 are uneven in size, so as the corrugated media 406*a* passes under the array of nozzles 102, certain locations on the surface may receive more printing fluid 418 than other locations. Both of these effects can lead to the non-uniform application of printing fluid on the corrugated media 406*a*.

FIG. 4B depicts corrugated media 406*b* that is concave in nature. The end regions of the sheet 406*b* are displaced from the conveyor belt 116 surface to a greater extent than the central region. The control parameters of the plurality of nozzles 104 are the same as in FIG. 3 for the flat corrugated media 306. As in FIG. 4A, printing fluid 418 may be applied non-uniformly to the corrugated media 406*b* unless adjustments to the control parameters are made.

Figure 4C:
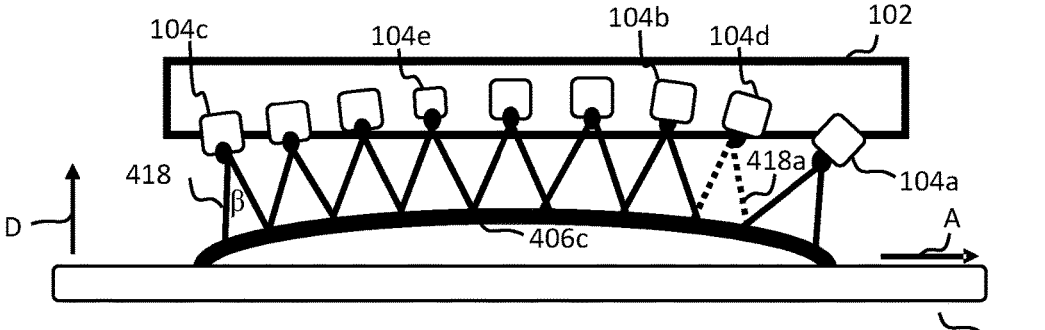
FIG. 4C is a schematic diagram showing a portion of the printing system adjusted to compensate for the type of corrugated media in accordance with an example.

FIG. 4C depicts a sheet of corrugated media 406*c* that is convex in nature. In this example, the control parameters for the array of nozzles 102 have been adjusted to compensate for the deformation of the corrugated media 406*c*. The adjustment of the control parameters, determined by the print controller 108, ensures that the printing fluid 418 is applied more uniformly than in the situations described in FIGS. 4A and 4B. This reduces or eliminates the unwanted effects associated with the non-uniform application of the printing fluid 418.

To compensate for the deformation of the corrugated media 406*c*, the deformation can first be determined, measured, calculated, or estimated by the printing system 100. The deformation can be determined through use of the sensor device 110, to measure or record sensor data. In one example, the deformation may be determined by taking an image of the corrugated media 406*c* using a camera. For example, a camera may comprise, or the camera may be, the sensor device 110 depicted in FIG. 1. Sensor data, such as an image taken by the camera, can be used to determine the deformation. For example, known image processing software, such as Matlab™, may be used to analyse the image to determine the deformation. Data captured or recorded by the sensor device 110 can be transmitted to the print controller 108 via the communication path 112 where it is analysed or used to determine the deformation.

In some examples, there may be more than one sensor device 110, for example there may be two or more cameras used to image the corrugated media 406*c*. In one specific example, a first camera is used to take an image of a side profile of the corrugated media 406*c*, and a second camera is used to take an image of the corrugated media 406*c* from above. Both images can be used by the print controller 108 to determine the deformation.

In some examples, the deformation is determined automatically, with little or no human input.

In one example, the deformation may be fully or partially determined by impinging electromagnetic radiation onto the surface of the corrugated media 406*c* and detecting the reflected electromagnetic radiation using a sensor device 110. Therefore in some examples the printing system 100 may also comprise an electromagnetic source device. The reflected intensity, time delay, and/or angle of incidence into the sensor device 110 may be used to determine the deformation of the corrugated media 406*c*. Data captured by the sensor device 110 can be used to determine the deformation, which again may be analysed using known image processing software. In some examples, the electromagnetic source device may be used in conjunction with one or more cameras. The electromagnetic radiation may be visible light, infra-red, or ultraviolet for example.

In a further example, ultrasound may be used to determine the deformation, whereby sound waves are reflected from the surface of the corrugated media 406*c* and detected using an appropriate sensor device 110.

The sensor device 110 may be used to sense the deformation before or while the corrugated media 106 is located on the conveyor belt 116. The corrugated media 106 may be stationary or in motion when the sensor device 110 collects sensor data.

Regardless of how the sensor device 110 is used to capture sensor data of the sheet of corrugated media 406*c*, the print controller 108 uses or analyses the sensor data to determine or estimate the deformation.

In an example, determining the deformation of the sheet of corrugated media 406*c* comprises determining height displacements of a plurality of locations on the sheet 406*c* with respect to a reference height. In one example, a side profile image captured by a camera may be analysed using a software program to estimate the height of a number of points along the sheet 406*c*. Any number of known algorithms may be invoked to detect the surface of the corrugated media 406*c* within the image. A number of predefined or arbitrary locations can be selected along this surface and their height displacement can be calculated. The height displacement may be calculated by counting the number of pixels each location is displaced from a reference location within the image, for example. In another example, sensor data from reflected sound waves or electromagnetic radiation may be used to calculate the height displacements of a plurality of locations.

Once the height displacements of a plurality of locations have been determined, a height displacement of at least one additional location on the sheet may be estimated based on the determined height displacements of the plurality of locations. In one example, this is performed by extrapolation using the determined height displacements of the plurality of locations on the sheet. In another example, this is performed by interpolation using the determined height displacements. Known methods of extrapolation and interpolation may be used. Accordingly, a more complete representation of the deformation can be determined based on a few initial measurements.

In some examples, an image captured by the camera can be used to generate a model of the sheet based on the captured image. As described above, a side profile image captured by a camera may be analysed using a software program detect the surface of the corrugated media 406*c* within the image. Once detected, a model can be generated using the image data. In one specific example, two or more cameras may each capture an image of the corrugated media from different angles. These images can be used to build a one, two, or three-dimensional model of the sheet. The generated model provides an accurate representation of the deformation which can be used by the print controller 108.

In some examples, the model may be described or approximated as a mathematical function expressed in one or more spatial dimensions. For example, flat corrugated media may be approximated as a one-dimensional function, and concave or convex corrugated media may be approximated as a two-dimensional function, or a three-dimensional function. Wave-like corrugated media may also be approximated as a two-dimensional function, or as a three-dimensional function. A two-dimensional function therefore approximates, or assumes the deformation is uniform along the third dimension, whereas a three-dimensional function may more accurately express the deformation of the whole surface of the corrugated media. Expressing the model as a mathematical function can allow control parameters to be more easily determined. Furthermore, gradients can be more easily calculated for different locations on the surface through the use of well-defined mathematical functions.

In one example, a mathematical function may be determined from an image taken of the corrugated media 406*c*. For example, a side profile image captured by a camera may be analysed using a software program to detect the surface of the corrugated media 406*c* within the image. Coordinate locations along this surface may be input into a least squares fitting algorithm, for example, to determine a mathematical function that most closely describes the surface.

Once the deformation has been determined, control parameters for the plurality of nozzles can be adjusted based on the deformation. Based on these adjusted control parameters, the print controller 108 may control a plurality of nozzles such that deposited printing fluid is applied according to the adjusted control parameters to ensure an even coating of the printing fluid. In an example, a set of rules may be defined and followed that adjust the control parameters to compensate for particular types and levels of deformation. For example, the gradient of the surface may be calculated or determined at one or more locations on the corrugated media, and based on the gradient the set of rules may specify that the nozzle 104, and/or adjacent nozzles 104 should be configured with specific control parameters.

One or more control parameters may be adjusted. In one example, an angle of tilt of a nozzle can be adjusted. For example, a nozzle may be rotated about one or more axes by an actuator, such as a motor. In FIG. 4C, nozzle 104*a* can be seen to be rotated/tilted through an angle, about an axis extending out of the page, when compared to the same nozzle in FIG. 4B. An instruction sent by the print controller 108 may cause the nozzle 104*a* to tilt to a pre-determined angle which is dependent on the deformation of the corrugated media 406*c* as seen by nozzle 104*a* at a particular moment in time. In one example, the angle of tilt of a nozzle 104 is caused to increase if a location on the media 406*c* below the nozzle 104 has a steep gradient when compared to other locations on the media surface 406*c*.

In another example, a vertical distance of a nozzle can be adjusted, where the vertical distance is defined as a distance perpendicular to the direction of motion of the media 406*c*, in the direction indicated by arrow D. For example, a nozzle's vertical distance from the sheet 406*c* may be adjusted by an actuator, such as a linear motor. In FIG. 4C, nozzle 104*b* can be seen to have increased its vertical distance from the corrugated media 406*c* when compared to the same nozzle in FIG. 4B. An instruction sent by the print controller 108 may cause the nozzle 104*b* to increase or decrease its vertical distance from the corrugated media 406*c* to a pre-determined level which is dependent on the deformation of the corrugated media 406*c* as seen by nozzle 104*b* at a particular moment in time. In one example, the vertical distance of a nozzle 104 is caused to increase if a location on the media 406*c* below the nozzle 104 has a large height displacement when compared to another location on the media 406*c*.

In another example, a spray angle of a nozzle can be adjusted. For example, a nozzle's spray angle may be adjusted by increasing or decreasing an aperture in the nozzle through which the printing fluid passes. In FIG. 4C, nozzle 104*c* can be seen to have decreased its spray angle to $\beta$ from $\alpha$ when compared to the same nozzle in FIG. 4B. An instruction sent by the print controller 108 may cause the nozzle 104*c* to narrow or widen its spray angle to a pre-determined angle which is dependent on the deformation of the corrugated media 406*c* as seen by nozzle 104*c* at a particular moment in time. In one example, the spray angle of a nozzle 104 is caused to increase if a location on the media 406*c* below the nozzle 104 has a small height displacement when compared to another location on the media 406*c*. In another example, the spray angle of a nozzle is caused to increase if a location on the media 406*c* below the nozzle 104 has a small gradient, for example is particularly flat, when compared to other locations.

In another example, a spray flow intensity of a nozzle can be adjusted. For example, a nozzle's spray flow intensity may be adjusted by increasing or decreasing the pressure applied to the printing fluid before being ejected by the nozzle. In FIG. 4C, nozzle 104*d* has decreased its spray flow intensity when compared to the same nozzle in FIG. 4B. This decrease is indicated by the dashed line of the print fluid 418*a*. In some examples, this also reduces the spray angle of the nozzle 104*d*, however in other examples the aperture may be adjusted to compensate for this effect to ensure that the spray angle remains unchanged. An instruction sent by the print controller 108 may cause the nozzle 104*d* to increase or decrease its spray flow intensity to a pre-determined rate which is dependent on the deformation of the corrugated media 406*c* as seen by nozzle 104*d* at a particular moment in time. In one example, the spray flow intensity of a nozzle 104 is caused to increase if a location on the media 406*c* below the nozzle 104 has a small height displacement when compared to another location on the media 406*c*, or when the gradient of the surface at that location is steep.

In another example, the motion of a nozzle can be adjusted. For example, a nozzle's motion may be adjusted independently of the other nozzles 104 in the array of nozzles 102. The motion may be adjusted by an actuator, such as a linear actuator. In FIG. 4C, nozzle 104*e* can be seen to have moved in a direction into the page, perpendicular to the direction indicated by arrow A, when compared to the same nozzle in FIG. 4B. This motion is indicated by the depicted size of the nozzle 104*e*, which has reduced due to perspective. An instruction sent by the print controller 108 may cause the nozzle 104*e* to move in a particular direction to a pre-determined location which is dependent on the deformation of the corrugated media 406*c* as seen by nozzle 104*e* at a particular moment in time.

Therefore, as mentioned, adjusting any or all of these control parameters in dependence on the deformation of the corrugated media, ensures a more uniform layer of print fluid is applied.

As indicated above, each nozzle 104 may be associated with one or more actuators to control motion in one or more directions or to control an angle of tilt. Each nozzle 104 may also be associated with an aperture and a print fluid pressure device. Each of these means for adjustment associated with the nozzles 104 are used to adjust different parameters according to control parameters determined by the print controller 108. Although specific adjustment means have been described, in some examples other known adjustment means may be used to adjust the different parameters.

In some examples, the control parameters may be adjusted for one nozzle 104 or a single nozzle 104, however in other examples the control parameters may be adjusted for more than one nozzle 104.

Control parameters may be expressed as a sequence of control parameters in time. For example, at a first time, $t_1$, a first nozzle may be configured according to first control parameter, and at a second, later time, $t_2$, the first nozzle may be configured according to a second control parameter. Adjustments to the nozzles control parameters may be made on the order of microseconds, milliseconds, or seconds, for example.

It will be appreciated that a control parameter for a particular nozzle may include control parameters for any or all of: an angle of tilt of the nozzle, a vertical distance of the nozzle from the sheet, a spray angle of the nozzle, a spray flow intensity of the nozzle, and/or a motion of the nozzle. Other control parameters may also be adjusted.

Signals sent along the communication paths 112, 114 may be sent using any appropriate communication protocol. The communication paths 112, 114 may be wired or wireless communication paths.

Figure 5:
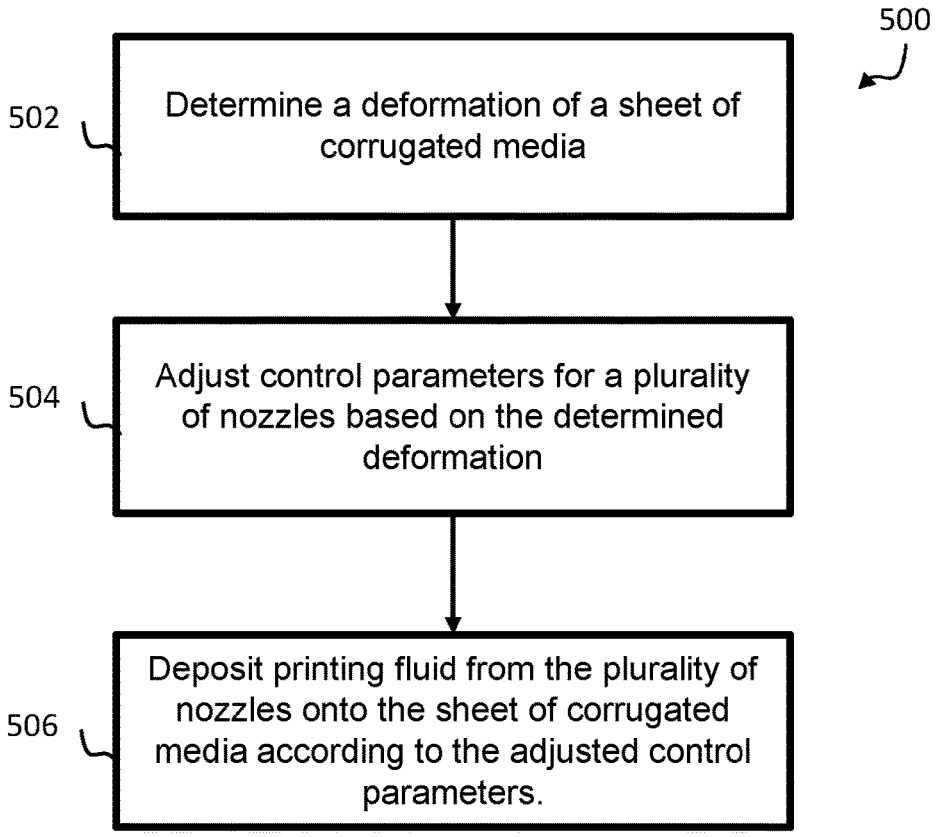
FIG. 5 is a flow diagram showing a method for depositing printing fluid on a sheet of corrugated media in accordance with an example.

FIG. 5 is a flow diagram showing a method 500. The method can be performed by the example printing system 100 discussed in relation to FIGS. 1-4, and is a method of depositing printing fluid on a sheet of corrugated media. At block 502, the method comprises determining a deformation of a sheet of corrugated media. At block 504, the method comprises adjusting control parameters for a plurality of nozzles based on the determined deformation. At block 506 the method comprises depositing printing fluid from the plurality of nozzles onto the sheet of corrugated media according to the adjusted control parameters.

In some example methods, determining the deformation of a sheet of corrugated media may comprise determining height displacements of a plurality of locations on the sheet with respect to a reference height, and estimating a height displacement of at least one additional location on the sheet based on the determined height displacements.

In some example methods, estimating the height displacement of an additional location on the sheet may be based on at least one of: an extrapolation of the determined height displacements of the plurality of locations on the sheet and an interpolation of the determined height displacements of the plurality of locations on the sheet.

In some example methods, determining the deformation of a sheet of corrugated media may comprise capturing an image of the sheet by a camera, and generating a model of the sheet based on the captured image. In some examples there may be more than one camera, each camera capturing one or more images, such that the model generated is based on some or all of the captured images.

In some example methods, determining the deformation of a sheet of corrugated media may comprise capturing sensor data using a sensor device, and generating a model of the sheet based on the sensor data.

In some example methods, generating a model of the sheet based on the captured image may comprise approximating the sheet as a mathematical function in at least one dimension. In one example, a concave or convex deformation may be approximated as a quadratic function expressed in two spatial dimensions.

In some example methods, adjusting the control parameters for the plurality of nozzles comprises adjusting at least one of: an angle of tilt of a nozzle, a vertical distance of a nozzle from the sheet, a spray angle of a nozzle, a spray flow intensity of a nozzle, and a motion of a nozzle.

In some example methods, a direction of motion of the sheet of corrugated media is perpendicular to a direction of the motion of the nozzle.

In some example methods, the printing fluid is one of an ink, a gloss, or a varnish.

Certain system components and methods described herein may be implemented by way of non-transitory computer program code that is storable on a non-transitory storage medium. In some examples, the print controller 108 may comprise a non-transitory computer readable storage medium comprising a set of computer-readable instructions stored thereon. The print controller 108 may further comprise one or more processors. In some examples, control may be split or distributed between two or more controllers 108 which implement all or parts of the methods described herein.

Figure 6:
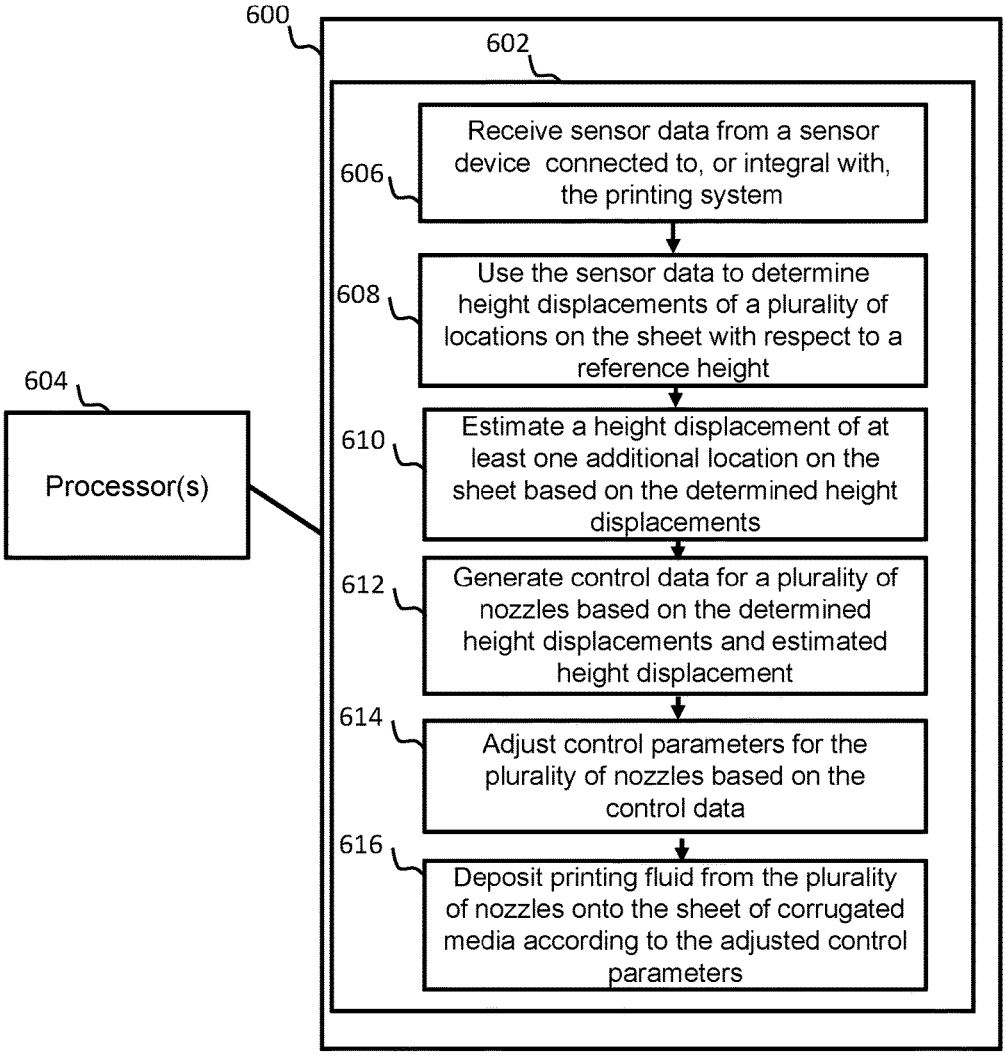
FIG. 6 is a diagrammatic representation of an example set of computer-readable instructions within a non-transitory computer-readable storage medium.

FIG. 6 shows an example of such a non-transitory computer-readable storage medium 600 comprising a set of computer readable instructions 602 which, when executed by at least one processor 604, cause the processor(s) 604 to perform a method according to examples described herein. The computer readable instructions 400 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc.

In an example, instructions 602 cause the processor 604 in a printing system to, at block 606 receive sensor data from a sensor device connected to, or integral with, the printing system. At block 608, the instructions 602 cause the processor 604 to use the sensor data to determine height displacements of a plurality of locations on the sheet with respect to a reference height. At block 610, the instructions 400 cause the processor 604 to estimate a height displacement of at least one additional location on the sheet based on the determined height displacements. At block 612, the instructions 602 cause the processor 604 to generate control data for a plurality of nozzles based on the determined height displacements and estimated height displacement. At block 614, the instructions 602 cause the processor 604 to adjust control parameters for the plurality of nozzles based on the control data. At block 612, the instructions 602 cause the processor 604 to deposit printing fluid from the plurality of nozzles onto the sheet of corrugated media according to the adjusted control parameters.

In some examples, the instructions 602 may further cause the processor 604 to adjust the control parameters for the plurality of nozzles by adjusting at least one of: an angle of tilt of a nozzle, a vertical distance of a nozzle from the sheet, a spray angle of a nozzle, a spray flow intensity of a nozzle, and a motion of a nozzle.

What is claimed is:

1. A method of depositing printing fluid on a sheet of corrugated media with an array of nozzles, the method comprising:

determining a height displacement of the sheet at multiple locations on the sheet with respect to a reference height;

determining a gradient of the height displacements at multiple locations along the sheet:

adjusting control parameters for each of multiple nozzles, including at least one of:

increasing an angle of tilt of the nozzle at a location of a gradient that is more steep than another gradient;

increasing a spray angle of the nozzle at a location of a height displacement that is smaller than another height displacement;

increasing a spray angle of the nozzle at a location of a gradient that is less steep than another gradient;

increasing a spray flow intensity of the nozzle at a location of a height displacement that is smaller than another height displacement; and increasing a spray flow intensity of the nozzle at a location of a gradient that is less steep than another gradient; and depositing printing fluid from the plurality of nozzles onto the sheet of corrugated media according to the adjusted control parameters.

2. The method of claim 1, wherein determining height displacements comprises:

measuring height displacements at multiple locations on the sheet; and estimating a height displacement of at least one additional location on the sheet based on the measured height displacements.

3. The method of claim 2, wherein estimating the height displacement of an additional location on the sheet is based on at least one of:

an extrapolation of the measured height displacements; and an interpolation of the measured height displacements.

4. The method of claim 1, wherein determining height displacements and gradients comprises:

capturing images of the sheet with multiple cameras; and generating a three-dimensional model of the sheet based on the captured images.

5. The method of claim 1, wherein the printing fluid is at least one of:

an ink;

a gloss; and a varnish.

6. A printing system comprising:

an array of nozzles arranged to deposit printing fluid on a sheet of corrugated media;

multiple cameras to capture images of the sheet;

a print controller configured to:

generate a three-dimensional model of the sheet based on images from the cameras;

determine from the model a height displacement of the sheet at multiple locations on the sheet with respect to a reference height;

determine from the model a gradient of the height displacements at multiple locations along the sheet;

adjust control parameters for the array of nozzles based on one or both of the height displacements and the gradients; and control the array of nozzles to deposit printing fluid onto the sheet of corrugated media based on the adjusted control parameters.

7. The printing system of claim 6, wherein the print controller is configured to adjust control parameters for each of multiple nozzles, including at least one of:

increasing an angle of tilt of the nozzle at a location of a gradient that is more steep than another gradient;

increasing a spray angle of the nozzle at a location of a height displacement that is smaller than another height displacement;

increasing a spray angle of the nozzle at a location of a gradient that is less steep than another gradient;

increasing a spray flow intensity of the nozzle at a location of a height displacement that is smaller than another height displacement; and increasing a spray flow intensity of the nozzle at a location of a gradient that is less steep than another gradient.

8. A non-transitory computer-readable storage medium storing instructions that, when executed by one or more processors, cause the one or more processors, in a printing system, to:

receive sensor data from a sensor device connected to, or integral with, the printing system;

use the sensor data to determine a height displacement of a sheet of corrugated media at multiple locations on the sheet with respect to a reference height and to determine a gradient of the height displacements at multiple locations along the sheet;

generate control data for multiple nozzles based on the determined height displacements and gradients;

adjust control parameters for the nozzles based on the control data, including at least one of:

increasing an angle of tilt of the nozzle at a location of a gradient that is more steep than another gradient;

increasing a spray angle of the nozzle at a location of a height displacement that is smaller than another height displacement;

increasing a spray angle of the nozzle at a location of a gradient that is less steep than another gradient;

increasing a spray flow intensity of the nozzle at a location of a height displacement that is smaller than another height displacement; and increasing a spray flow intensity of the nozzle at a location of a gradient that is less steep than another gradient; and deposit printing fluid from the nozzles onto the sheet of corrugated media according to the adjusted control parameters.

9. The medium of claim 8, wherein the sensor data includes images from multiple cameras and the instructions to use the sensor data include instructions to use the images to generate a three-dimensional model of the sheet to determine the height displacements and the gradients.

* * * * *